US012735295B2

(12) United States Patent
Wang et al.

(10) Patent No.: US 12,735,295 B2
(45) Date of Patent: Sep. 15, 2026

(54) TRANSFER RACK

(71) Applicants: ZHEJIANG HENGYI PETROCHEMICAL CO., LTD., Hangzhou (CN); Shaoxing Keqiao Hengming Chemical Fiber Co., Ltd., Shaoxing City (CN)

(72) Inventors: Peng Wang, Hangzhou (CN); Jinmei Ni, Hangzhou (CN); Yibo Qiu, Hangzhou (CN); Xiantao Peng, Hangzhou (CN); Bin Lv, Hangzhou (CN); Dake Li, Hangzhou (CN); Feng Xu, Hangzhou (CN)

(73) Assignees: ZHEJIANG HENGYI PETROCHEMICAL CO., LTD., Zhejiang (CN); SHAOXING KEQIAO HENGMING CHEMICAL FIBER CO., LTD., Shaoxing City (CN)

( * ) Notice: Subject to any disclaimer, the term of this patent is extended or adjusted under 35 U.S.C. 154(b) by 36 days.

(21) Appl. No.: 19/071,427

(22) Filed: Mar. 5, 2025

(65) Prior Publication Data

US 2025/0320082 A1 Oct. 16, 2025

(30) Foreign Application Priority Data

Apr. 10, 2024 (CN) ..... 202410431747.6

(51) Int. Cl.
*B65H 67/06* (2006.01)

(52) U.S. Cl.
CPC ..... *B65H 67/067* (2013.01); *B65H 2701/31* (2013.01)

(58) Field of Classification Search
CPC ..... B65H 49/38; B65H 49/16; B65H 67/02; B65H 67/06; B65H 67/064; B65H 67/065;

(Continued)

(56) References Cited

U.S. PATENT DOCUMENTS 3,297,276 A * 1/1967 Skufca ..... B65H 49/38 211/1
5,688,098 A 11/1997 Theno (Continued)

FOREIGN PATENT DOCUMENTS

CN 105692326 A * 6/2016 ..... B65H 49/38
CN 107142536 A 9/2017

(Continued)

OTHER PUBLICATIONS

Mar. 18, 2026—(JP) Notice of Allowance—App. No. 2025-061721 w Eng. Translation.
Jul. 21, 2025—(EP) Extended Search Report—App. No. 25161738.7.

*Primary Examiner* — Anna M Momper
*Assistant Examiner* — Katelynne R Burrell
(74) *Attorney, Agent, or Firm* — Banner & Witcoff, Ltd.

(57) ABSTRACT

A transfer rack is provided, including a rack, a pushing mechanism, and a stabilizing mechanism. The rack includes a base, a vertical plate, and hanging rods. The hanging rods are hierarchically hanged above the base. The pushing mechanism includes a push plate and a first power component connected with the push plate. The push plate has through-holes matched with the hanging rods, the push plate is slidably arranged on the hanging rods through the through-holes, and the first power component is provided to drive the push plate to move the goods to be transferred. The stabilizing mechanism includes support pillars, support beams, and second power components. The support beams cross the hanging rods under layers of the hanging rods respectively, two ends of one of the support beams are connected with the support pillars, and the support beams are lifted and lowered under driving of the second power components.

11 Claims, 6 Drawing Sheets

(58) Field of Classification Search
CPC ..... B65H 67/067; B65H 2701/31; B65H 49/324; B65H 49/325; B65H 2402/32; B65H 2402/33; B60P 3/035; Y10S 414/124; B65G 65/00; B65G 1/02; B61D 15/00; B61D 45/00; B61D 47/00; B62B 3/02; B62B 3/104; B62B 3/002
See application file for complete search history.

(56) References Cited

U.S. PATENT DOCUMENTS

| | | | | |
|---|---|---|---|---|
| 2025/0083584 | A1* | 3/2025 | Wang | B65G 67/24 |
| 2025/0100841 | A1* | 3/2025 | Peng | B65H 54/547 |

FOREIGN PATENT DOCUMENTS

| | | | | | |
|---|---|---|---|---|---|
| CN | 110777447 | A | * | 2/2020 | B65H 49/38 |
| CN | 111747230 | A | | 10/2020 | |
| CN | 112079186 | A | * | 12/2020 | B65G 47/24 |
| CN | 114455396 | A | | 5/2022 | |
| CN | 114920069 | A | * | 8/2022 | B65H 67/06 |
| DE | 102023004098 | A1 | * | 4/2025 | B65H 67/067 |
| IT | RM20120391 | A1 | * | 2/2014 | B65H 49/16 |
| JP | S63225074 | A | | 9/1988 | |
| JP | 1-288503 | A | | 11/1989 | |
| JP | 9-30731 | A | | 2/1997 | |
| JP | 2001506214 | A | | 5/2001 | |
| JP | 3225982 | U | | 4/2020 | |

* cited by examiner

TRANSFER RACK

CROSS-REFERENCE TO RELATED APPLICATIONS

The present application claims priority to Chinese Patent Application No. CN202410431747.6, filed on Apr. 10, 2024, the disclosure of which is hereby incorporated herein by reference in its entirety.

FIELD

The present disclosure relates to the field of production equipment technologies, particularly to a transfer rack.

BACKGROUND

When yarn spindles produced by a winding machine are transported to a subsequent production process, each rod of yarn spindles needs to be stored as a whole rod by using a transfer vehicle or a transfer rack, and then the yarn spindles are taken out one by one when needed for a next step of operation. Due to a fact that a quantity of a single rod of yarn spindles is usually no less than ten, the rod for hanging the yarn spindles is relatively long and only one end is fixed. Therefore, the end used for accessing the yarn spindles is prone to shaking, making it difficult to quickly and accurately grasp the yarn spindles.

SUMMARY

Embodiments of the present disclosure provide a transfer rack for solving one or more problems in the field.

In a first aspect, embodiments of the present disclosure provide a transfer rack including:

a rack including a base, a vertical plate and a plurality of hanging rods, where the vertical plate is vertically arranged at one end of the base, one side of the vertical plate is connected with fixed ends of the plurality of hanging rods, the plurality of hanging rods are hierarchically hanged above the base, and the plurality of hanging rods deposit and remove goods to be transferred through free ends of the plurality of hanging rods;

a pushing mechanism including a push plate and a first power component connected with the push plate, where the push plate has a plurality of through-holes matched with the plurality of hanging rods, the push plate is slidably arranged on the plurality of hanging rods through the plurality of through-holes, and the first power component is provided to drive the push plate to move the goods to be transferred towards the free ends; and a stabilizing mechanism including support pillars, a plurality of support beams and second power components, where the plurality of support beams cross the plurality of hanging rods under layers of the plurality of hanging rods respectively, two ends of a support beam are connected with the support pillars, and the support beams are lifted and lowered under driving of the second power components, so as to support the hanging rods or the goods to be transferred above the support beams.

In an implementation, two sides of the base are respectively provided with first sliding rails parallel to the plurality of hanging rods, and bottoms of the support pillars are arranged in the first sliding rails; when the pushing mechanism drives the goods to be transferred, the stabilizing mechanism keeps in contact with the plurality of hanging rods or the goods to be transferred while following the goods to be transferred to move to the free ends.

In an implementation, the stabilizing mechanism includes a first stabilizing mechanism and a second stabilizing mechanism;

in a first state in which the plurality of hanging rods are fully loaded with the goods to be transferred, the first stabilizing mechanism is arranged in middle of the plurality of hanging rods, and the second stabilizing mechanism is arranged at a rear part of a group of goods to be transferred, where the rear part is close to the fixed ends of the hanging rods;

in a second state in which a part of the goods to be transferred before the first stabilizing mechanism are removed, the first stabilizing mechanism moves to the free ends of the plurality of hanging rods, and support beams in the first stabilizing mechanism are separated from the hanging rods and are lowered to a preset height to avoid remaining goods to be transferred, at this moment, the second stabilizing mechanism moves to the middle of the plurality of hanging rods; and in a third state in which all the goods to be transferred are removed, the first stabilizing mechanism and the second stabilizing mechanism are at the free ends of the plurality of hanging rods.

In an implementation, a support beam includes a vertical board part and a transverse board part, and a bottom of the vertical board part is vertically connected with the transverse board part.

In an implementation, a top end of the vertical board part has curved grooves matching curved surfaces of lower portions of the hanging rods, and when the support beam and corresponding hanging rods are in a state of counteracting against with each other, the support beam forms an enclosure on at least parts of side surfaces of the hanging rods through the curved grooves.

In an implementation, a curved surface of a curved groove is provided with a plurality of roller grooves in which rollers are provided, a part of a circumferential surface of the roller is higher than the curved surface of the curved groove on both sides of the roller, and the circumferential surface is directly opposite a center of the curved surface.

In an implementation, protection pads for counteracting against the goods to be transferred are provided on the vertical board part, the protection pad includes a front side portion and a rear side portion, the front side portion and the rear side portion have a curved notch matching the curved groove, and top ends of the front side portion and the rear side portion are connected through a connecting portion at both ends of the curved notch.

In an implementation, the support pillar is provided with a plurality of second sliding rails, connectors at two ends of the support beam extend into the second slide rails, lifting rods are arranged in the support pillars, the lifting rods are connected with the second power components, and the lifting rods are connected with the connectors of the support beams through a plurality of connecting rods, the second power components cause the support beams to lift or lower by driving the lifting rods.

In an implementation, the second sliding rail has a straight line segment extending in a vertical direction and a curved segment extending vertically downward to gradually tending to extend horizontally, the connectors at the two ends of the support beam include an upper pillar head and a lower pillar head, when the connectors slide downward in the second sliding rails, the lower pillar head enters the curved segment and produces displacement in a horizontal direction, and a displacement difference between the upper pillar head and the lower pillar head in the horizontal direction makes the support beams be inclined.

In an implementation, the bottoms of the support pillars are provided with strip-shaped sliding blocks, the sliding blocks are placed in the first sliding rails, a length of the sliding block is greater than 3 times a diameter of the support pillars, and upper and lower sides of two ends of the sliding block are respectively provided with a group of pulleys.

In an implementation, one side of circumferential surfaces of at least two of the plurality of hanging rods is provided with racked rails extending in an axial direction, a highest part of the racked rails is lower than the circumferential surfaces, the racked rails are connected with an output mechanism of the corresponding first power component, and the push plate is driven to move on the plurality of hanging rods when the first power component is working.

The embodiments of the present disclosure adopt the above solution to reduce the shaking of the hanging rods and improve stability and depositing and removal efficiency of the goods to be transferred in a process of moving a transfer cart and the goods to be transferred.

It should be understood that the content described in this part is not intended to identify critical or essential features of embodiments of the present disclosure, nor is it used to limit the scope of the present disclosure. Other features of the present disclosure will be understood through the following description.

BRIEF DESCRIPTION OF THE DRAWINGS

In the accompanying drawings, same or similar components or elements are represented by same reference numerals throughout the accompanying drawings, unless otherwise specified. The accompanying drawings may not necessarily be drawn to scale. It should be understood that the accompanying drawings only depict some embodiments provided according to the present disclosure and should not be considered as limiting the scope of the present disclosure.

Figure 1:
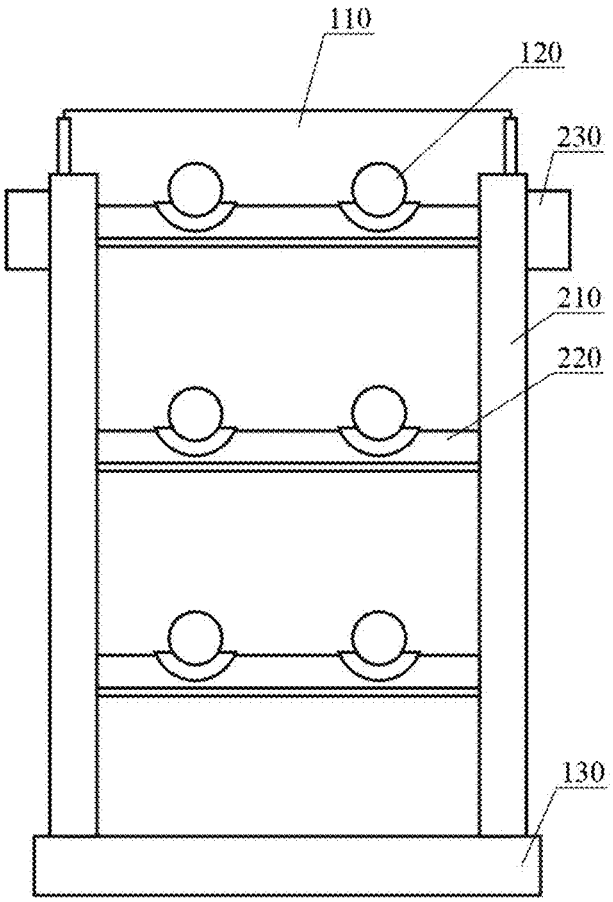
FIG. 1 shows a front-view structure diagram of a transfer rack according to an embodiment of the present disclosure.

Description of reference numerals: 110, vertical plate; 120, hanging rod; 130, base; 210, support pillar; 211, lifting rod; 212, connecting rod; 213, second sliding rail; 214, sliding block; 215, pulley; 220, support beam; 221, vertical board part; 222, transverse board part; 223, curved groove; 224, protection pad; 225, roller; 226, connector; 230, second power component; 231, outputting mechanism; 310, push plate; 320, first power component; 400, good to be transferred.

DETAILED DESCRIPTION

Hereinafter, only some exemplary embodiments are briefly described. As those having ordinary skill in the art may recognize, the described embodiments may be modified in various ways without departing from spirit or scope of the present disclosure. Therefore, the accompanying drawings and description are considered to be illustrative in nature rather than restrictive.

FIG. 1 shows a front-view structure diagram of a transfer rack according to an embodiment of the present disclosure. As shown in FIG. 1, the transfer rack includes:

- a rack including a base 130, a vertical plate 110 and a plurality of hanging rods 120, where the vertical plate 110 is vertically arranged at one end of the base 130, one side of the vertical plate 110 is connected with fixed ends of the plurality of hanging rods 120, the plurality of hanging rods 120 are hierarchically hanged above the base 130, and the plurality of hanging rods 120 deposit and remove goods to be transferred 400 through free ends of the plurality of hanging rods 120;
- a pushing mechanism including a push plate 310 and a first power component 320 (e.g., a first power device 320) connected with the push plate 310, where the push plate 310 has a plurality of through-holes matched with the plurality of hanging rods 120, the push plate 310 is slidably arranged on the plurality of hanging rods 120 through the plurality of through-holes, and the first power component 320 is provided to drive the push plate 310 to move the goods to be transferred 400 towards the free ends; and
- a stabilizing mechanism including support pillars 210, a plurality of support beams 220 and a second power component 230 (e.g., a second power device 230), where the plurality of support beams 220 cross the plurality of hanging rods 120 under layers of the plurality of hanging rods 120 respectively, two ends of the support beam 220 are connected with the support pillars 210, and the support beams 220 are lifted and lowered under driving of the second power component 230, so as to support the hanging rods 120 or the goods to be transferred 400 above the support beams 220.

In an embodiment of the present disclosure, wheels may be provided under the base 130 to make the rack be movable on the ground or rails. The goods to be transferred 400 may be in a cylinder shape or a circular disc shape, and center axes of the goods to be transferred 400 have holes for connecting the hanging rods 120. Each hanging rod 120 may accept a whole rod of goods to be transferred from a production device or another transfer device, then deliver the goods to transferred to a sorting station, and the goods to be transferred may be removed one by one by a human or a device such as a robotic arm to facilitate subsequent processing. In an example, the goods to be transferred 400 are yarn spindles produced by a winding machine, as shown in FIG. 1 which does not show the goods to be transferred, the one side of the vertical plate 110 is connected with 6 hanging rods 120 in the cylinder shape, and the 6 hanging rods 120 are divided into 3 layers for being hanged above the base 130.

The pushing mechanism may move on the hanging rods 120, and may push the goods to be transferred on the hanging rods when moving. When goods to be transferred at the outermost ends of the hanging rods are removed, the pushing mechanism pushes remaining goods to be transferred to move to the free ends of the hanging rods to facilitate removal of the goods to be transferred, especially to facilitate the robotic arm to carry out grasping at the same position every time. When using the robotic arm to grab the goods to be transferred, the robotic arm may grasp a good to be transferred at the outermost end of each rod at the same time, thereby improving depositing and removal efficiency.

In order to avoid shaking of the hanging rods caused by movement of the transfer rack or removal of the previous batch of goods to be transferred, the stabilizing mechanism is provided in the embodiment of the present disclosure. The stabilizing mechanism includes the plurality of support beams 220 crossing the plurality of hanging rods 120 under the layers of the plurality of hanging rods 120 respectively and supporting the hanging rods under them. Meanwhile, the support beams 220 adjust heights under the driving of the second power component 230, and may counteract against or be separated from the hanging rods 120 to prevent movement or removal of the goods to be transferred from being blocked.

Figure 2:
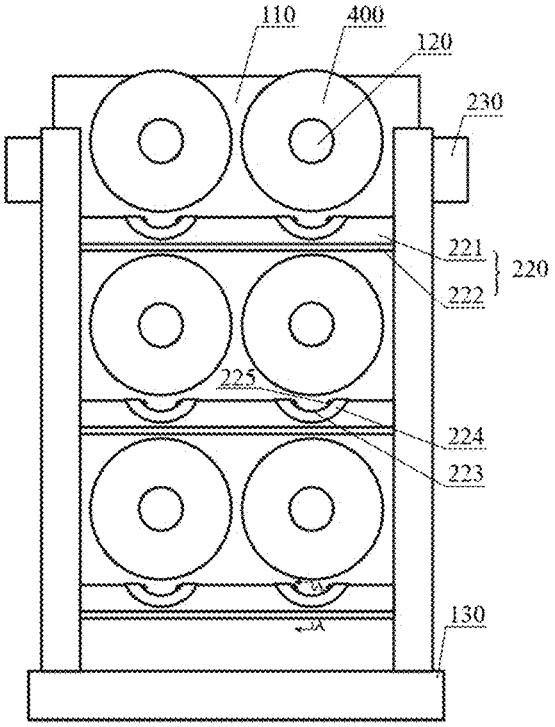
FIG. 2 shows a front-view structure diagram of a transfer rack after loading items to be transferred according to an embodiment of the present disclosure.

In an implementation, the support pillars 210 may be arranged at a position close to the free ends of the hanging rods 120, and is positioned behind the goods to be transferred at the outermost ends, and whenever the goods to be transferred at the outermost ends are removed, the second power component 230 drives the support beams 220 to lower, separate from the hanging rods 120, and lower to a specified height, as shown in FIG. 2. After the pushing mechanism moves the remaining goods to be transferred to the free ends of the hanging rods for a fixed distance, the second power component 230 drives the support beams 220 to lift again and counteract against the hanging rods, so as to support the hanging rods and avoid the shaking of the hanging rods. The support beams 220 may counteract against bottoms of the goods to be transferred or counteract against the hanging rods through gaps between adjacent goods to be transferred. Under a condition that the goods to be transferred have tubular inner cores and the inner cores protrude outward, the support beams 220 may counteract against the inner cores through the gaps between the adjacent goods to be transferred.

According to the scheme of the embodiment of the present disclosure, in a process of moving the transfer rack and removing the goods to be transferred, the shaking of the hanging rods and the goods to be transferred may be reduced, and stability and the depositing and removal efficiency are improved.

In an implementation, two sides of the base 130 are respectively provided with first sliding rails parallel to the plurality of hanging rods 120, and bottoms of the support pillars 210 are arranged in the first sliding rails. When the pushing mechanism drives the goods to be transferred 400, the support beams 220 in the stabilizing mechanism keep in contact with the plurality of hanging rods 120 or the goods to be transferred 400 while following the goods to be transferred 400 to move to the free ends.

In an embodiment of the present disclosure, because the bottoms of the support pillars 210 in the stabilizing mechanism are arranged in the first sliding rails, the stabilizing mechanism may move along the first sliding rails. After the support pillars 210 and the support beams 220 are lifted and counteract against the hanging rods 120 or the goods to be transferred 400, they may move together with the goods to be transferred 400 until the goods to be transferred 400 reach the ends of the hanging rods. Subsequently, the support beams 220 are lowered and separated from the hanging rods, so that the remaining goods to be transferred are not blocked.

According to the scheme of the embodiment of the present disclosure, the stabilizing mechanism moves together with the goods to be transferred, and the support beams do not need to be frequently lifted and lowered, so that the stability and removal efficiency may be further improved.

Figure 3:
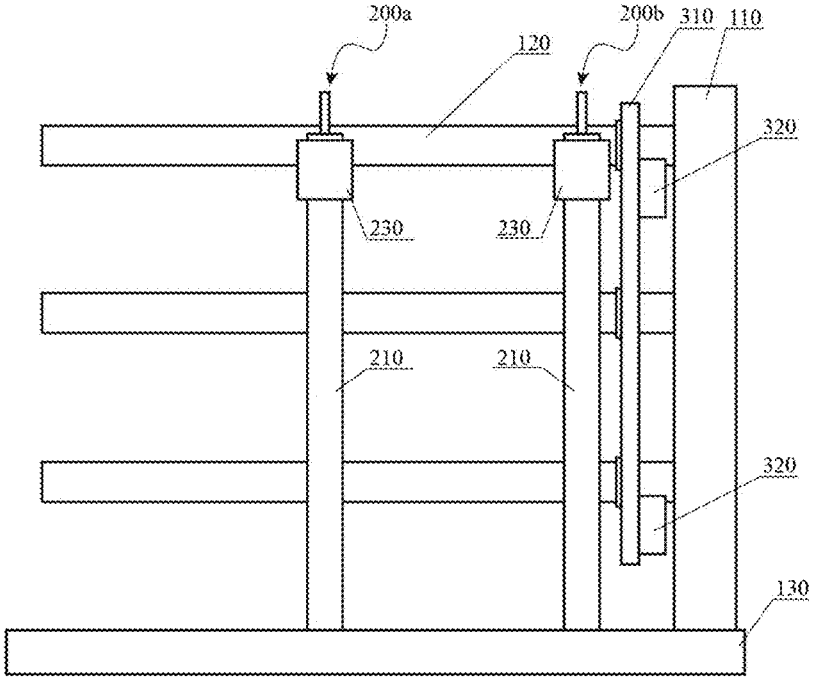
FIG. 3 shows a side-view structure diagram of a transfer rack according to an embodiment of the present disclosure.
Figure 4A:
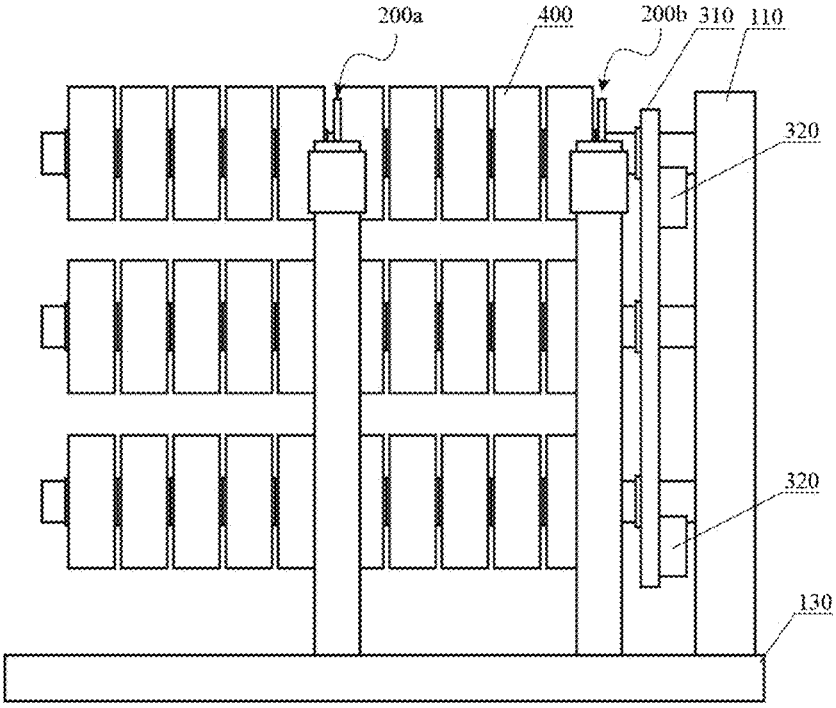
FIGS. 4A to 4C show a schematic diagram of working state change of a transfer rack according to an embodiment of the present disclosure.

In the above-mentioned implementations, an initial position of the stabilizing mechanism is arranged in a middle of the hanging rods and may play a better supporting effect. The goods to be transferred are divided into front and rear parts with the stabilizing mechanism as a boundary, and after the stabilizing mechanism follows the goods to be transferred 400 to move to an end position thereof at the ends of the hanging rods, the support beam 220 is separated from the hanging rods, so that the stabilizing mechanism fails. As a result, the rear part of the goods to be transferred lost auxiliary support of the stabilizing mechanism when they are being removed. In order to better address the above issue, as shown in FIG. 3, in an implementation, the stabilizing mechanism includes a first stabilizing mechanism 200*a* and a second stabilizing mechanism 200*b*. Bottoms of the first stabilizing mechanism 200*a* and the second stabilizing mechanism 200*b* are slidably arranged in the first sliding rails of the base 130. Combination of the first stabilizing mechanism 200*a* and the second stabilizing mechanism 200*b* is used to improve the removal efficiency of the goods to be transferred, specifically, referring to FIGS. 4A to 4C, a combination manner includes:

As shown in FIG. 4A, in a first state in which the plurality of hanging rods 120 are fully loaded with the goods to be transferred 400, the first stabilizing mechanism 200*a* is arranged in the middle of the plurality of hanging rods 120, and the second stabilizing mechanism 200*b* is arranged at a rear part of a group of goods to be transferred 400, where the rear part is close to the fixed ends of the hanging rods 120.

Figure 4B:
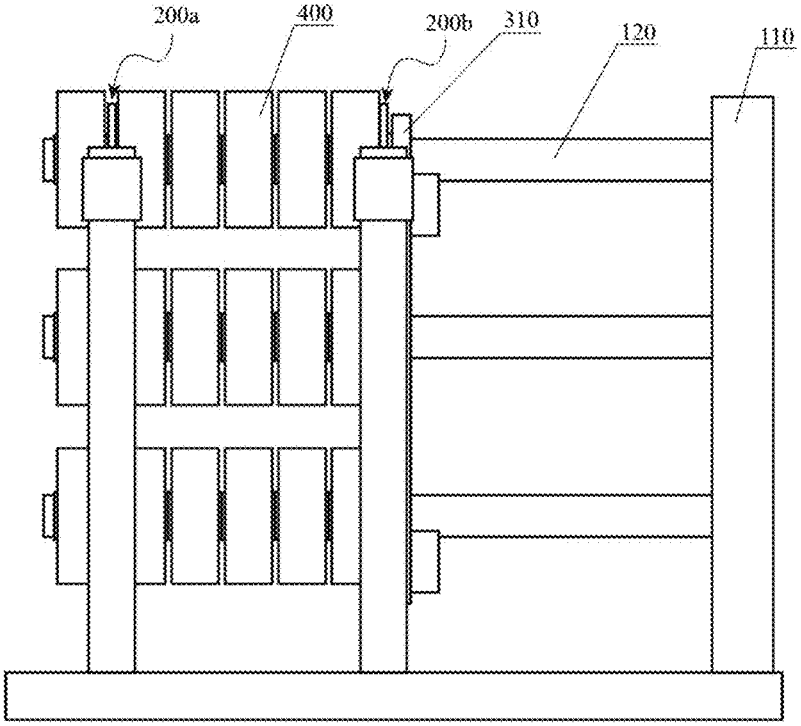
Figure 4C:
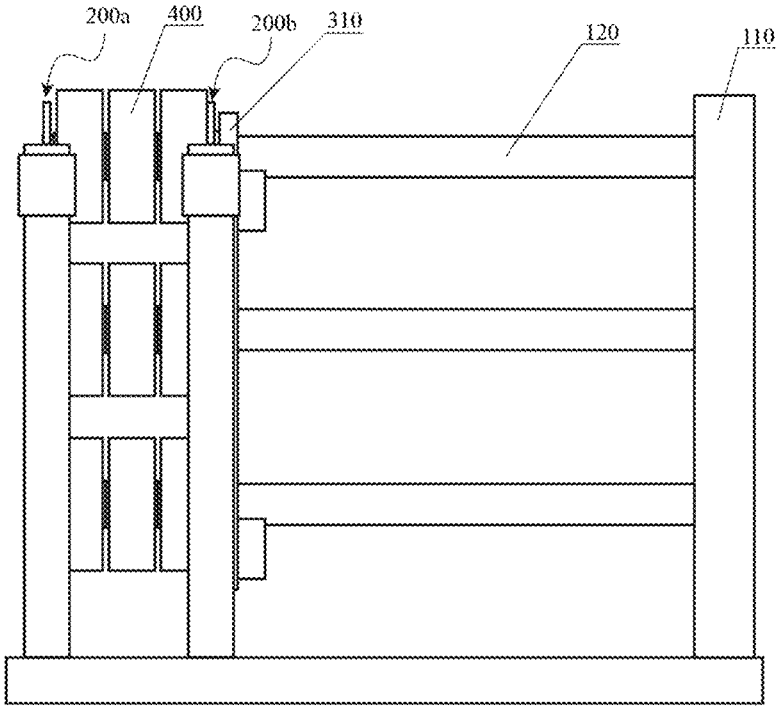

As the first stabilizing mechanism 200*a*, the second stabilizing mechanism 200*b* and the goods to be transferred 400 move together to the free ends of the hanging rods under driving of the pushing mechanism, the transfer rack gradually changes to a state shown in FIG. 4B.

Then, in a second state in which a part of the goods to be transferred 400 before the first stabilizing mechanism 200*a* is removed, the first stabilizing mechanism 200*a* moves to the free ends of the plurality of hanging rods 120, and the support beams in the first stabilizing mechanism 200*a* are separated from the hanging rods 120 and are lowered to a preset height to avoid the remaining goods to be transferred 400. At this moment, the second stabilizing mechanism 200*b* moves from the fixed ends of the plurality of hanging rods 120 to the middle, and may continue to follow the remaining goods to be transferred 400 to move to the free ends.

Because the first stabilizing mechanism 200*a* is separated from the hanging rods and the goods to be transferred, the pushing mechanism no longer drives the first stabilizing mechanism 200*a*. As the second stabilizing mechanism 200*b* and the goods to be transferred 400 continue to move to the free ends of the hanging rods together under the driving of the pushing mechanism, the transfer rack gradually changes to a state shown in FIG. 4C.

Then, in a third state in which all the goods to be transferred 400 are removed, the first stabilizing mechanism 200*a* and the second stabilizing mechanism 200*b* are at the free ends of the plurality of hanging rods 120.

In an embodiment of the present disclosure, the first stabilizing mechanism 200*a* and the second stabilizing mechanism 200*b* relay and cooperate with each other, and when the first stabilizing mechanism 200*a* is separated from the hanging rods, the middle of the hanging rods has been supported by the second stabilizing mechanism 200*b*, so as to ensure that a first half of the hanging rods is always supported, further reduce the shaking of the free ends, and also make all the goods to be transferred on the whole rods may be removed smoothly.

In an implementation, referring to FIG. 2, the support beam 220 includes a vertical board part 221 and a transverse board part 222, and a bottom of the vertical board part 221 is vertically connected with the transverse board part 222.

In an embodiment of the present disclosure, the bottom of the vertical board part 221 is vertically connected with the transverse board part 222 to improve structural strength of the support beam 220. The vertical board part 221 extends into the gap between the two adjacent goods to be transferred, and the vertical board part 221 may have a height greater than the radius of the goods to be transferred, so that the transverse board part 222 is outside the gap, so that it may have a larger thickness.

According to the scheme of the embodiment of the present disclosure, structural strength of the support beams is improved, and deformation of the support beams during being used is avoided.

In an implementation, referring to FIG. 2, a top end of the vertical board part 221 is provided with curved grooves 223 matching curved surfaces of lower portions of the hanging rods 120, and when the support beam 220 and corresponding hanging rods 120 are in a state of counteracting against with each other, the support beam 220 forms an enclosure on at least parts of side surfaces of the hanging rods 120 through the curved grooves 223.

In an embodiment of the present disclosure, the support beams 220 counteract against the hanging rods 120 through the curved grooves 223, so that the support beams 220 not only have upward supporting forces on the hanging rods, but also may provide supporting forces in a horizontal direction, and the shaking of the hanging rods in the horizontal direction may be avoided. Especially when the transfer rack turns, shaking of the hanging rods and the goods to be transferred from side to side is avoided.

In an implementation, still referring to FIG. 2, a curved surface of the curved groove 223 is provided with a plurality of roller grooves in which rollers 225 are provided, a part of a circumferential surface of the roller 225 is higher than the curved surface of the curved groove 223 on both sides of the roller, and the circumferential surface is directly opposite a center of the curved surface.

In an embodiment of the present disclosure, the support beams 220 are in contact with the hanging rods 120 through the rollers 225 in the curved grooves 223, so that friction is reduced when displacement occurs between the support beams 220 and the hanging rods.

Figure 5:
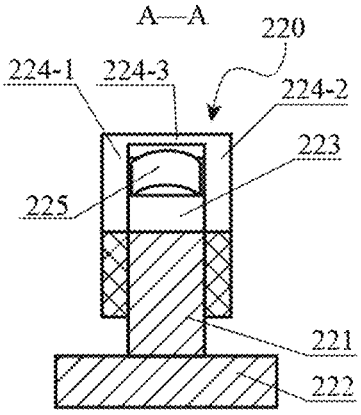
FIG. 5 is a cross-sectional view of A-A in FIG. 2.

FIG. 5 is a cross-sectional view of A-A in FIG. 2. As shown in FIG. 5, in an implementation, protection pads 224 for counteracting against the goods to be transferred 400 are provided on the vertical board part 221, the protection pad 224 includes a front side portion 224-1 and a rear side portion 224-2, the front side portion 224-1 and the rear side portion 224-2 have a curved notch matching the curved groove 223, and top ends of the front side portion 224-1 and the rear side portion 224-2 are connected through a connecting portion 224-3 at both ends of the curved notch.

In an embodiment of the present disclosure, two sides of the curved groove 223 are surrounded by the protection pad 224 made of a softer material, so that the vertical board part 221 is isolated from the goods to be transferred 400, and the goods to be transferred 400 are protected.

Figure 6:
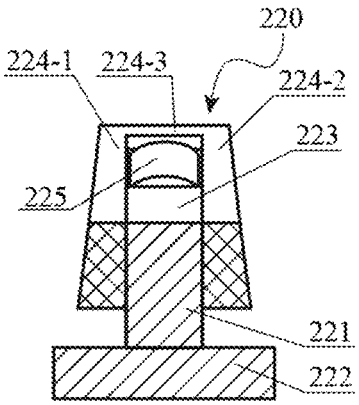
FIG. 6 is a structure diagram of another implementation of FIG. 5.

FIG. 6 is a structure diagram of another implementation of FIG. 5, in which, the protection pad 224 have a thickness gradually increased from top to bottom, and a thickness at the thickest part is greater than the minimum width of the gap between the two adjacent goods to be transferred. In this way, in a process of extending into the gap, the vertical board part 221 may separate the two adjacent two goods to be transferred, so that the hanging rods are exposed, so that the vertical board part 221 directly counteracts against the hanging rods, and avoids counteracting against the goods to be transferred 400, and the goods to be transferred are further protected.

In an implementation, the support pillar 210 is provided with a plurality of second sliding rails 213, connectors 226 at two ends of the support beam 220 extend into the second slide rails 213, a lifting rod 211 is arranged in the support pillar 210, the lifting rod 211 is connected with the second power component 230, and the lifting rod 211 is connected with the connector 226 through a plurality of connecting rods 212, the second power component 230 causes the support beams 220 to lift or lower by driving the lifting rod 211.

In an embodiment of the present disclosure, when the stabilizing mechanism is arranged between a plurality of goods to be transferred 400, when the goods to be transferred behind the support beam 220 in the stabilizing mechanism need to cross the support beams 220, the support beam 200 needs to reduce the height so that it is placed in a gap below the current layer of goods to be transferred, so as to avoid having an impact on movement of the current layer and the lower layer of the goods to be transferred. Therefore, the lifting rod 211 may be arranged in the support pillar 210, and the second power component 230 may be arranged on outside of top or bottom of the support pillar 210. The lifting rod 211 is driven through the second power component 230 to produce a displacement on a vertical direction, and the connecting rods 212 on the lifting rod 211 drive the support beam 220 to lift and lower together.

Figure 7A:
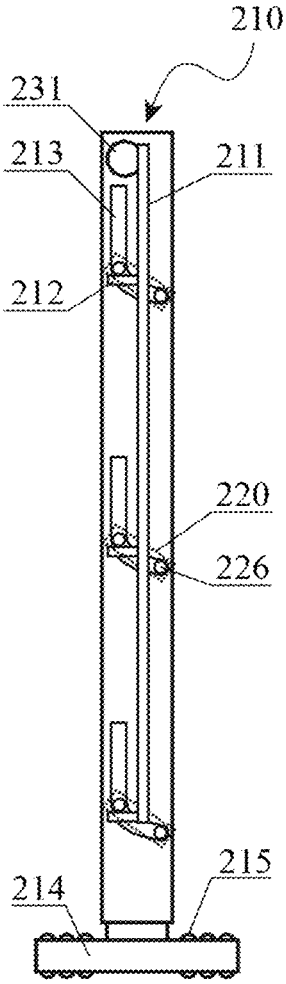
FIGS. 7A and 7B show a perspective structure diagram of a part of a support pillar 210 according to an embodiment of the present disclosure.
Figure 7B:
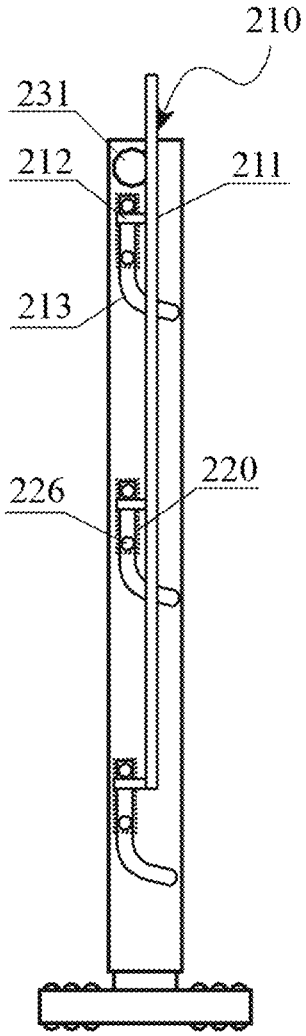

FIGS. 7A and 7B show a perspective structure diagram of a part of the support pillar 210, FIGS. 7A and 7B correspond to two state changes. As shown in FIGS. 7A and 7B, in an implementation, the plurality of second sliding rails 213 have a straight line segment extending in the vertical direction and a curved segment extending vertically downward to gradually tending to extend horizontally. The connector 226 at the two ends of the support beam 220 includes an upper pillar head and a lower pillar head, the connecting rod 212 is connected with the upper pillar head of the connector 226, when the connector 226 slides downward in the second sliding rail 213, the lower pillar head enters the curved segment and produces displacement on the horizontal direction, and a displacement difference between the upper pillar head and the lower pillar head in the horizontal direction makes the support beam 220 be inclined.

In an embodiment of the disclosure, the support beam 220 first descends in height in the straight line section of the second sliding rail 213, and after a large part of the support beam 220 withdraws from the gap between the goods to be transferred, the lower pillar head of the support beam 220 is guided by the curved segment to produce the displacement on the horizontal direction, so that the support beam 220 is inclined and space occupation in the vertical direction is rapidly reduced.

In an implementation, as shown in FIG. 7A, the bottom of the support pillar 210 is provided with a strip-shaped sliding block 214, the sliding block 214 is placed in the first sliding rail, and a length of the sliding block 214 is greater than 3 times a diameter of the support pillar 210. Upper and lower sides of two ends of the sliding block 214 are respectively provided with a group of pulleys 215.

In an embodiment of the disclosure, stability of the support pillar 210 may be enhanced through the strip-shaped sliding block 214, and a group of pulleys 215 are respectively arranged on the upper and lower sides, so that the support pillar 210 is smoother when moving.

In an implementation, one side of circumferential surfaces of at least two of the plurality of hanging rods 120 is provided with racked rails extending in an axial direction, the highest part of the racked rails is lower than the circumferential surfaces, the racked rails are connected with an output mechanism of the corresponding first power component 320, and the push plate 310 is driven to move on the plurality of hanging rods 120 when the first power component 320 is working.

In an embodiment of the disclosure, the racked rails are buried in the hanging rods 120, and the first power component 320 of the pushing mechanism is matched with the rack rails, so that when the first power component 320 is working, the push plate 310 is driven to move on the plurality of hanging rods 120. In order to improve the stability of the pushing mechanism, the pushing mechanism is provided with at least two first power components 320, and the plurality of first power components 320 are symmetrically arranged at center points of the plurality of hanging rods 120. For example, when the hanging rods are 3 layers and 2 rows, the two first power components 320 may be arranged at a position of two hanging rods corresponding to a middle layer on the push plate, and may also be arranged at a position of a left hanging rod corresponding to the first layer and a right hanging rod of the third layer.

Other components of the transfer rack of the above embodiments may be adopted in various schemes known to those having ordinary skill in the art now and in the future, and are not described in detail here.

In the explanation of the description, it is understandable that orientations or positional relationships indicated by terms "center", "longitudinal", "crosswise", "length", "width", "thickness", "up", "down", "front", "rear", "left", "right", "vertical", "horizontal", "top", "bottom", "inner", "outside", "clockwise", "counterclockwise", "axial", "radial", "circumferential" and the like are orientations or positional relationships shown based on the drawings, and are intended only for convenience and simplification of the present disclosure, and do not indicate or imply that the apparatus or element referred to must have a particular orientation, be constructed and operated in a particular orientation, and therefore cannot be construed as a limitation on the present disclosure.

In addition, terms "first" and "second" are used for descriptive purposes only and should not be construed as indicating or implying relative importance or implying a quantity of features indicated. Thus, features that are defined as "first" and "second" may explicitly or implicitly include one or more of these features. In the description of the present disclosure, "a plurality of" means two or more, unless otherwise expressly and specifically qualified.

In the present disclosure, unless otherwise expressly specified or qualified, terms "mounted", "connected", "coupled", "fixed" and the like shall be construed broadly, for example, they may be fixedly connected, detachably connected, or in integral; they may be mechanically connected, electrically connected, or in communication connection; they may be directly connected or indirectly connected through an intermediate medium, they may be internal connection of two elements or interaction relationship between two elements. For those having ordinary skill in the art, specific meaning of the above terms in the present disclosure may be understood on a case-by-case basis.

In the present disclosure, unless otherwise expressly specified or qualified, a first feature being "above" or "below" a second feature may include direct contact between the first and second features, or may also include the first and second features are not in direct contact but through additional feature contact between them. Moreover, the first feature being "above", "on", and "over" the second feature includes the first feature directly above and obliquely above the second feature, or simply indicates that a level of the first feature is higher than a level of the second feature. The first feature being "below", "under", and "beneath" the second feature includes the first feature directly below and diagonally below the second feature, or simply indicating that the level of the first feature is less than the level of the second feature.

The disclosure above provides a number of different embodiments or examples to achieve different structures of the present disclosure. In order to simplify the disclosure of the present disclosure, parts and settings of examples are described above. Of course, they are only examples and are not intended to limit the present disclosure. In addition, the present disclosure may repeat the reference numbers and/or reference letters in different examples, and this repetition is for the purpose of simplification and clarity and does not in itself indicate the relationship between the various embodiments and/or settings in question.

The foregoing is only embodiments of the present disclosure, and is not intended to limit the protection scope, and a person skilled in the art may think of various changes or substitutions within the scope of the embodiments disclosed in the present disclosure, and these changes or substitutions should be covered by the protection scope of the present disclosure. Therefore, the protection scope of the present disclosure shall be subject to the protection scope of the claims.

What is claimed is:

1. A transfer rack comprising:

a rack comprising a base, a vertical plate, and a plurality of hanging rods, wherein the vertical plate is vertically arranged at one end of the base, one side of the vertical plate is connected with fixed ends of the plurality of hanging rods, the plurality of hanging rods are hierarchically hanged above the base, and wherein the plurality of hanging rods deposit and remove goods to be transferred through free ends of the plurality of hanging rods;

a pushing mechanism comprising a push plate and a first power device connected with the push plate, wherein the push plate has a plurality of through-holes matched with the plurality of hanging rods, the push plate is slidably arranged on the plurality of hanging rods through the plurality of through-holes, and wherein the first power device is provided to drive the push plate to move the goods to be transferred towards the free ends of the plurality of hanging rods; and a stabilizing mechanism comprising support pillars, a plurality of support beams and second power devices, wherein the plurality of support beams cross the plurality of hanging rods under layers of the plurality of hanging rods respectively, two ends of one of the plurality of support beams are connected with the support pillars, and the plurality of support beams are lifted and lowered under driving of the second power devices, to support the plurality of hanging rods or the goods to be transferred above the plurality of support beams.

2. The transfer rack of claim 1, wherein two sides of the base are respectively provided with first sliding rails parallel to the plurality of hanging rods, and a bottom of one of the support pillars is arranged in one of the first sliding rails, and wherein, based on the pushing mechanism driving the goods to be transferred, the stabilizing mechanism keeps in contact with the plurality of hanging rods or the goods to be transferred while following the goods to be transferred to move to the free ends of the plurality of hanging rods.

3. The transfer rack of claim 2, wherein the stabilizing mechanism comprises a first stabilizing mechanism and a second stabilizing mechanism;

in a first state in which the plurality of hanging rods are fully loaded with the goods to be transferred, the first stabilizing mechanism is arranged in a middle of the plurality of hanging rods, and the second stabilizing mechanism is arranged at a rear part of a group of the goods to be transferred, wherein the rear part is close to the fixed ends of the plurality of hanging rods;

in a second state in which a part of the goods to be transferred before the first stabilizing mechanism is removed, the first stabilizing mechanism moves to the free ends of the plurality of hanging rods, and support beams in the first stabilizing mechanism are separated from the plurality of hanging rods and are lowered to a preset height to avoid remaining goods to be transferred, at this moment, the second stabilizing mechanism moves to the middle of the plurality of hanging rods; and in a third state in which the goods to be transferred are removed, the first stabilizing mechanism and the second stabilizing mechanism are at the free ends of the plurality of hanging rods.

4. The transfer rack of claim 1, wherein the support beam comprises a vertical board part and a transverse board part, and a bottom of the vertical board part is vertically connected with the transverse board part.

5. The transfer rack of claim 4, wherein a top end of the vertical board part has curved grooves matching curved surfaces of lower portions of the plurality of hanging rods, and based on the support beam and corresponding hanging rods being in a state of counteracting against with each other, the support beam forms an enclosure on parts of side surfaces of the corresponding hanging rods through the curved grooves.

6. The transfer rack of claim 5, wherein a curved surface of one of the curved grooves is provided with a plurality of roller grooves in which rollers are provided, a part of a circumferential surface of one of the rollers is higher than the curved surface of the curved groove on both sides of the roller, and the circumferential surface is directly opposite a center of the curved surface.

7. The transfer rack of claim 5, wherein protection pads for counteracting against the goods to be transferred are provided on the vertical board part, one of the protection pads comprises a front side portion and a rear side portion, the front side portion and the rear side portion have a curved notch matching one of the curved grooves, and top ends of the front side portion and the rear side portion are connected through a connecting portion at both ends of the curved notch.

8. The transfer rack of claim 1, wherein one of the support pillars is provided with a plurality of second sliding rails, connectors at two ends of the support beam extend into the plurality of second slide rails, lifting rods are arranged in the support pillars, the lifting rods are connected with the second power devices, and the lifting rods are connected with the connectors of the support beam through a plurality of connecting rods, the second power devices cause the support beam to lift or lower by driving the lifting rods.

9. The transfer rack of claim 8, wherein one of the second sliding rails has a straight line segment extending in a vertical direction and a curved segment extending vertically downward to gradually tending to extend horizontally, the connectors at the two ends of the support beam comprise an upper pillar head and a lower pillar head, based on the connectors sliding downward in the second sliding rail, the lower pillar head enters the curved segment and produces displacement in a horizontal direction, and a displacement difference between the upper pillar head and the lower pillar head in the horizontal direction makes the support beam be inclined.

10. The transfer rack of claim 2, wherein the bottom of the support pillar is provided with a strip-shaped sliding block, the sliding block is placed in the first sliding rail, a length of the sliding block is greater than 3 times a diameter of the support pillar, and upper and lower sides of two ends of the sliding block are respectively provided with a group of pulleys.

11. The transfer rack of claim 1, wherein one side of circumferential surfaces of at least two of the plurality of hanging rods is provided with racked rails extending in an axial direction, a highest part of the racked rails is lower than the circumferential surfaces, the racked rails are connected with an output mechanism of the first power device, and the push plate is driven to move on the plurality of hanging rods based on the first power device being driving.

* * * * *